US006837067B2

(12) United States Patent
Lee

(10) Patent No.: US 6,837,067 B2
(45) Date of Patent: Jan. 4, 2005

(54) REFRIGERATOR USING DOUBLE SUCTION TYPE CENTRIFUGAL BLOWER

(75) Inventor: Sang Wook Lee, Seoul (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 10/610,552

(22) Filed: Jul. 2, 2003

(65) Prior Publication Data

US 2004/0107725 A1 Jun. 10, 2004

(30) Foreign Application Priority Data

Dec. 10, 2002 (KR) ..... 10-2002-0078291

(51) Int. Cl.[7] ..... F25D 11/02; F25D 17/04
(52) U.S. Cl. ..... 62/441; 62/408
(58) Field of Search ..... 62/441, 407, 408, 62/440

(56) References Cited

U.S. PATENT DOCUMENTS 6,209,342 B1 * 4/2001 Banicevic et al. ..... 62/443

* cited by examiner

*Primary Examiner*—Chen Wen Jiang
(74) *Attorney, Agent, or Firm*—Greenblum & Bernstein, P.L.C.

(57) ABSTRACT

This invention is to increase a floor area ratio of a freezing chamber and a utilization rate of heat transfer. A refrigerator is disclosed, which includes a cabinet having a storage space, a mullion provided in the cabinet to divide the storage space into a freezing chamber and a refrigerator chamber, the mullion having a cold airflow passage provided therein that is communicated with the freezing chamber and the refrigerator chamber, a double suction centrifugal blower provided in a middle space of the mullion and sucking air from the freezing chamber and the refrigerator chamber and exhausting to the cold airflow passage, an evaporator provided in the cold airflow passage for exchanging heat with the air exhausted from the double suction centrifugal blower, a top outlet and a bottom outlet exhausting air being passed through the evaporator to the freezing chamber and the refrigerator chamber.

18 Claims, 5 Drawing Sheets

REFRIGERATOR USING DOUBLE SUCTION TYPE CENTRIFUGAL BLOWER

CROSS-REFERENCE TO RELATED APPLICATIONS

This application claims the benefit of Korean Application No. P2002-0078291, filed on Dec. 10, 2002, which is hereby incorporated by reference as if fully set forth herein.

BACKGROUND OF THE INVENTION

1. Field of the Invention

The present invention relates to a refrigerator, and more particularly, to a refrigerator using a double suction centrifugal blower.

2. Discussion of the Related Art

In general, a refrigerator is an apparatus for taking storage of foods freshly for a long-term period. As illustrated in FIG. 1, a refrigerator includes an evaporation chamber 3 having a cabinet 1, a mullion 2, an evaporator 3*a* and a fan 3*b* and an apparatus chamber having a refrigerant duct, a compressor and a condenser.

Explaining the composition of the refrigerator, the cabinet 1 has a storage space inside. The mullion 2 divides the storage space in the cabinet into a freezing chamber 1*a* and refrigerator chamber 1*b*. The cold airflow passage is formed in the mullion 2 so as to flow refrigerant between the freezing chamber 1*a* and the refrigerator chamber 1*b*. The refrigerant duct 4 being connected to a cold airflow passage 2*a* transfers refrigerant to each section of the refrigerator chamber 1*b*.

The evaporator 3*a* is provided in the evaporation chamber 3 being provided at a side of the freezing chamber 1*a*. The fan 3*b* ventilates refrigerant being generated from the evaporator 3*a* in the evaporation chamber 3. The compressor 5*a* driving the evaporator 3*a* and the condenser 5*b* generating heat are provided in the apparatus chamber 5 at bottom of the refrigerator chamber.

A conventional refrigerator formed as above operates as followed. First, when power is supplied, the compressor 5*a* in the apparatus chamber 5 operates. And, the evaporator 3*a* in the evaporation chamber 3 is cooled so as to lower temperature in the evaporation chamber 3. When the fan 3*b* provided in the evaporation chamber 3 rotates an blows cooled air toward the freezing chamber 1*a*, refrigerant moved to the freezing chamber 1*a* is guided to the refrigerant duct 4 after passing through a cold airflow passage 2*a* provided in the mullion 2.

Refrigerant guided to the cool air duct 4 flows in the refrigerator chamber 1*b* and lower temperature the refrigerator chamber 1*b*. Refrigerant in the refrigerator chamber 1*b* is entered into the cold airflow passage 2*a* and repeats the above process after entering into the evaporation chamber 3.

However, the conventional refrigerator has problems as followed. First, the evaporation chamber 3 is provided at a side of the freezing chamber 1*a* and the floor area ratio of a freezing chamber is reduced.

Second, the evaporator 3*a* is vertically provided in a narrow space at a side of the refrigerator chamber 1*a*. Proper heat-exchange of circulating cool air with the evaporator is not realized so that the cool air flows into the freezing chamber 1*a*. Therefore, a utilization rate of heat transfer area of the evaporator 3*a* is lowered and the effect of heat transmission is lowered.

SUMMARY OF THE INVENTION

Accordingly, the present invention is directed to a refrigerator using a double suction centrifugal blower that substantially obviates one or more problems due to limitations and disadvantages of the related art.

An object of the present invention is to provide a refrigerator increasing a floor area ratio of a freezing chamber.

Another object of the present invention is to provide a refrigerator increasing a utilization rate of heat transfer area.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, the refrigerator includes a cabinet having a storage space, a mullion provided in the cabinet to divide the storage space into a freezing chamber and a refrigerator chamber, the mullion having a cold airflow passage provided therein that is connected with the freezing and the refrigerator chamber, a double suction centrifugal blower provided in a middle space of the mullion and sucking air from the freezing chamber and the refrigerator chamber and exhausting to the cold airflow passage, and an evaporator provided in the cold airflow passage for exchanging heat with the air exhausted from the double suction centrifugal blower.

The evaporator includes a fin and a refrigerant tube, the evaporator covering an outer circumferential surface of the double suction centrifugal blower. It is desirable that the evaporator includes the fin and the refrigerant tube being as a single body.

The fin includes a plurality of a louver 42*a* having a part being incised and a side being processed to be projected, and an opening unit between the part incised and the louver. The louver is inclined to be parallel to a flow direction of air exhausted from the double suction centrifugal blower and a tangent line direction of the double suction centrifugal blower.

The refrigerator further includes a top outlet and a bottom outlet exhausting cool air being passed through the evaporator to the freezing chamber and the refrigerator chamber. The refrigerator further includes a damper, which adjusts opening size by opening and closing according to temperature of the refrigerator chamber at the bottom outlet of a cold airflow passage provided at the mullion.

In another aspect of the present invention, a refrigerator includes a cabinet having a storage space, a mullion provided in the cabinet to divide the storage space into a freezing chamber and a refrigerator chamber, the mullion having a cold airflow passage provided therein that is communicated with the freezing chamber and the refrigerator chamber, a double suction centrifugal blower provided at a middle space of the mullion and the double suction centrifugal blower sucking air in the freezing chamber and the refrigerator chamber and exhausting to a cold airflow passage, an evaporator provided in the cold airflow passage and exchanging heat with air exhausted from the double suction centrifugal blower, a plurality of top outlets and a plurality of bottoms outlets exhausting air passed through the evaporator to the freezing chamber and the refrigerator chamber respectively, and a cool air duct connected with the bottom outlet and extended from top to bottom of the refrigerator.

The structure and composition of the evaporator is the same as the first embodiment of the invention. The cool air duct includes a plurality of through-holes. The through-holes provided at the cool air duct includes a damper, which adjusts opening size by opening and closing according to temperature of the refrigerator chamber at the bottom outlet of a cold airflow passage provided at the mullion.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiments of the invention and together with the description serve to explain the principle of the invention. In the drawings.

DETAILED DESCRIPTION OF THE INVENTION

Reference will now be made in detail to the preferred embodiments of the present invention, examples of which are illustrated in the accompanying drawings. Wherever possible, the same reference numbers will be used throughout the drawings to refer to the same or like parts.

Figure 1:
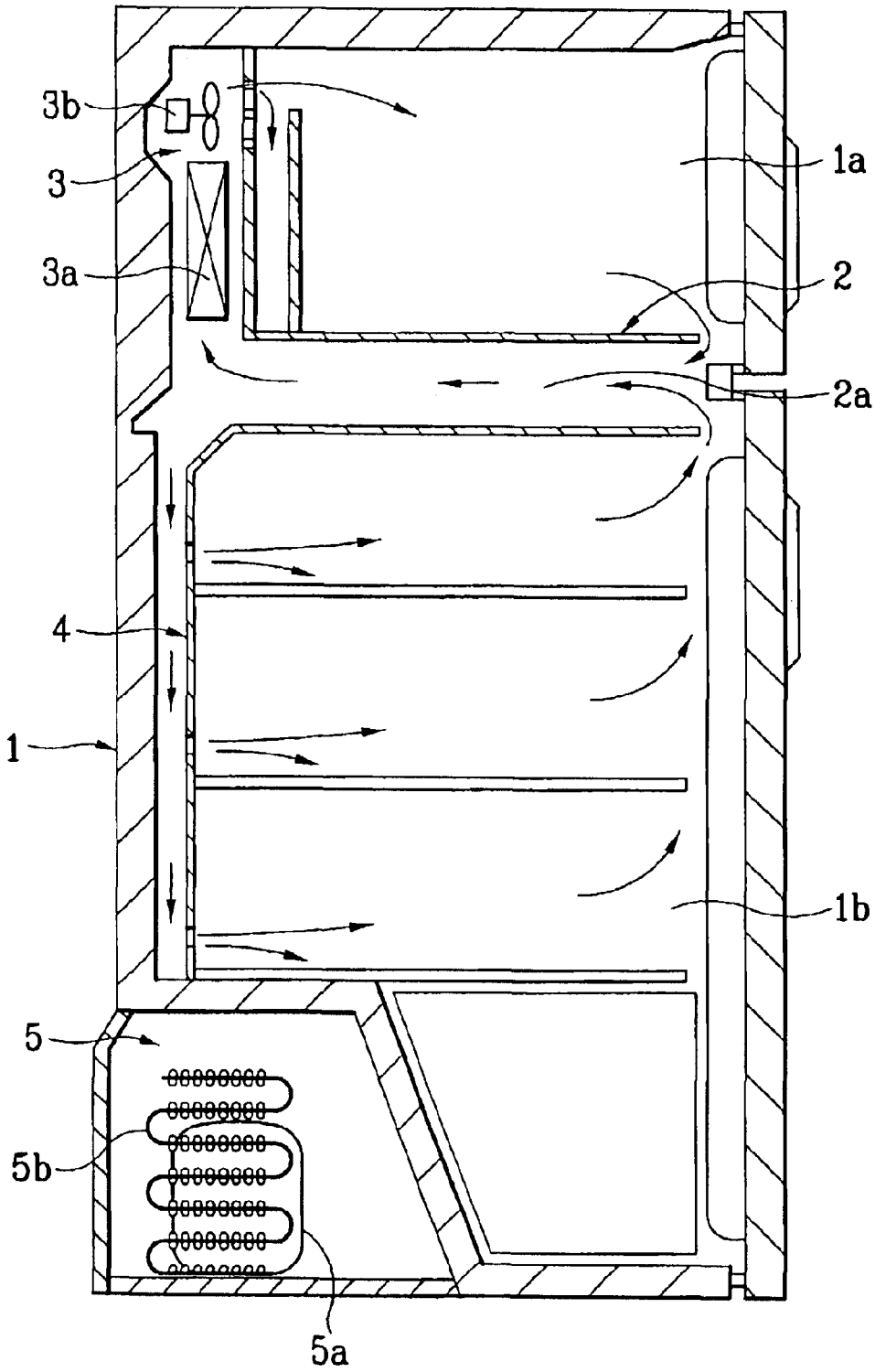
FIG.1 Related Art
FIG. 1 illustrates a longitudinal section view of a structure of a conventional refrigerator.
Figure 2:
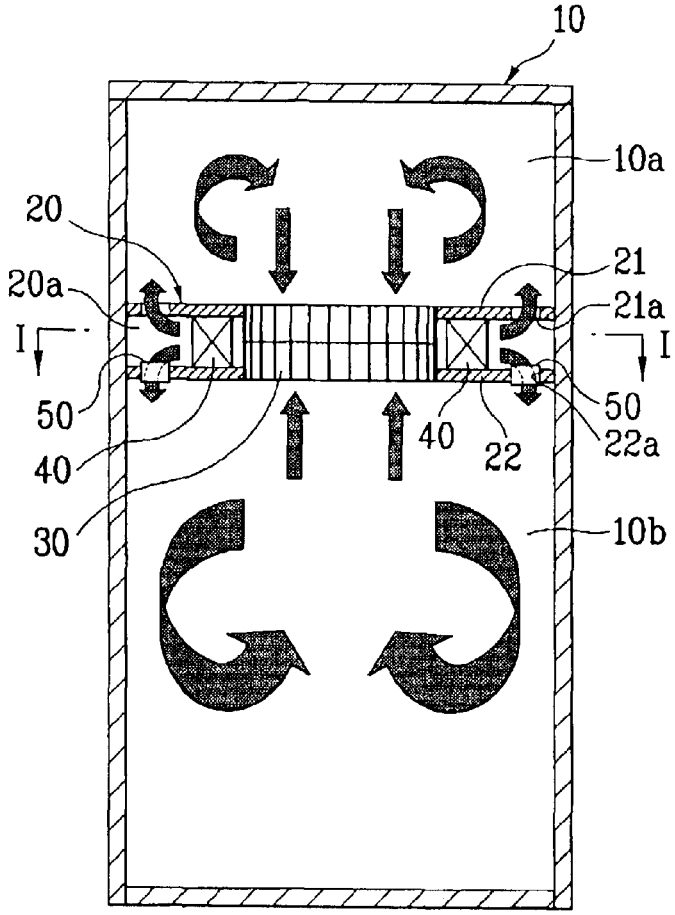
FIG. 2 illustrates a schematic view of a refrigerator according to a first of the present invention.
Figure 3:
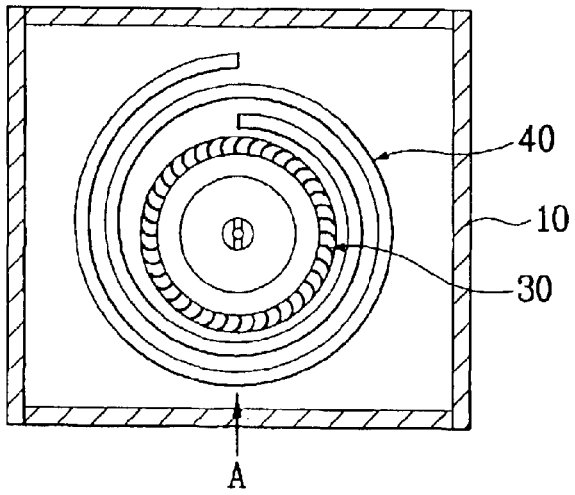
FIG. 3 illustrates a cross-sectional view taken along the line I—I of FIG. 2.

FIG. 2 is a schematic view of a refrigerator according to the present invention, and FIG. 3 is a cross sectional view taken along the line I—I of FIG. 2.

Hereinafter, a first embodiment of the present invention is explained in detail. A refrigerator according to the present invention includes a cabinet 10, a mullion 20, double suction centrifugal blower 30 and outlets 21*a* and 21*b*.

As illustrated in FIGS. 2 and 3, the cabinet has a storage space inside and the mullion 20 dividing the cabinet into a freezing chamber 10*a* and refrigerator chamber 10*b*. The mullion 20 is formed in double diaphragm and includes a top panel 21 and a bottom panel 22. A cold airflow passage is formed between the panels 21 and 22.

The double suction centrifugal blower 30 is an apparatus for sucking air from the middle thereof and discharging the sucked air to both sides thereof, and provided at a part vertically passing through the central part of the mullion 20. The evaporator 40 is provided at the cold airflow passage 20*a* for exchanging heat with air exhausted from the double suction centrifugal blower 30. A top outlet passage 21*a* and a bottom outlet passage 22*a* are provided at a top surface 21 and a bottom surface 22 of the mullion 20.

Figure 4:
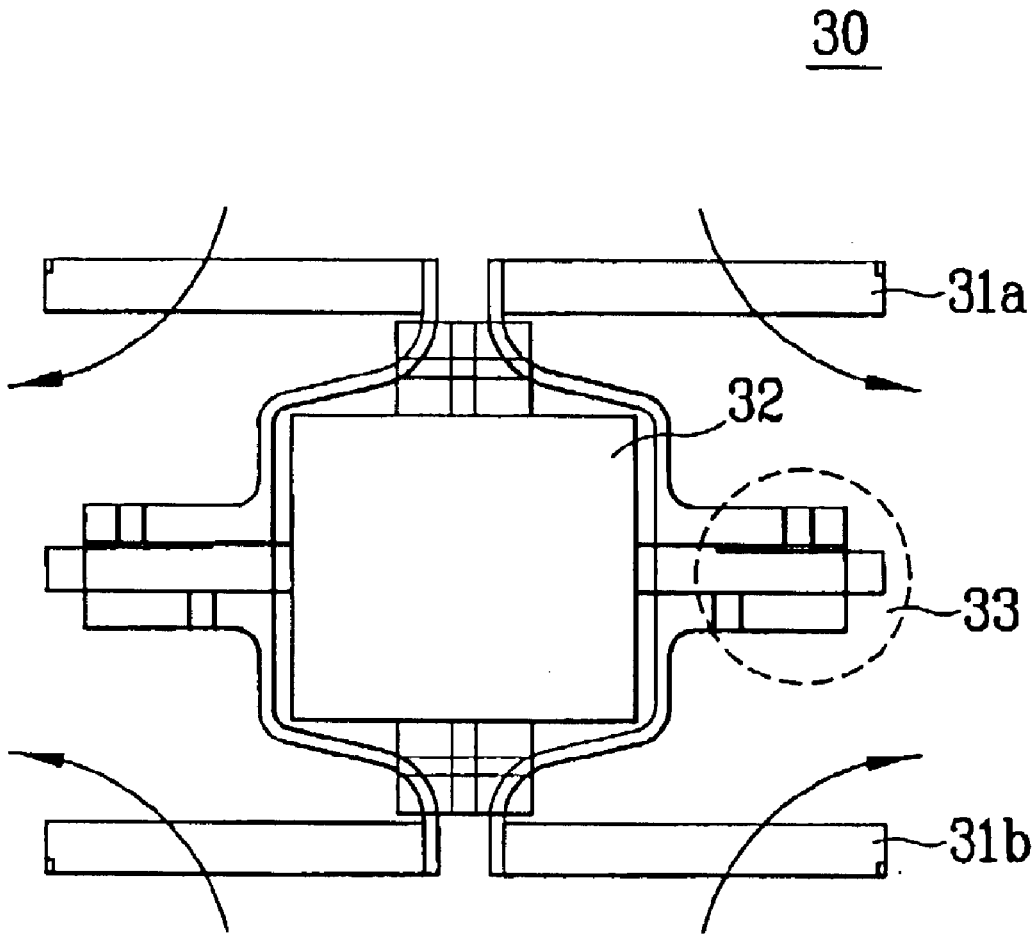
FIG. 4 illustrates a front view of double suction centrifugal blower applied to a refrigerator.

As illustrated in FIG. 4, the double suction centrifugal blower 30 used in the present invention sucks air from a top and a bottom thereof by driving a motor 32 and rotating a top blade 31*a* and a bottom blade 31*b* provided at top and bottom thereof respectively.

A projected unit 33 is provided at each side of the motor 32 to couple the motor 32 with a housing and to protect air sucked from top and bottom from being interrupted by each other. Therefore, the double suction centrifugal blower 30 is an apparatus for sucking air from top and bottom thereof and discharging the sucked air in space between the top blade 31*a* and the bottom blade 31*b* in the radius direction or a tangent line direction at the same time.

Figure 5:
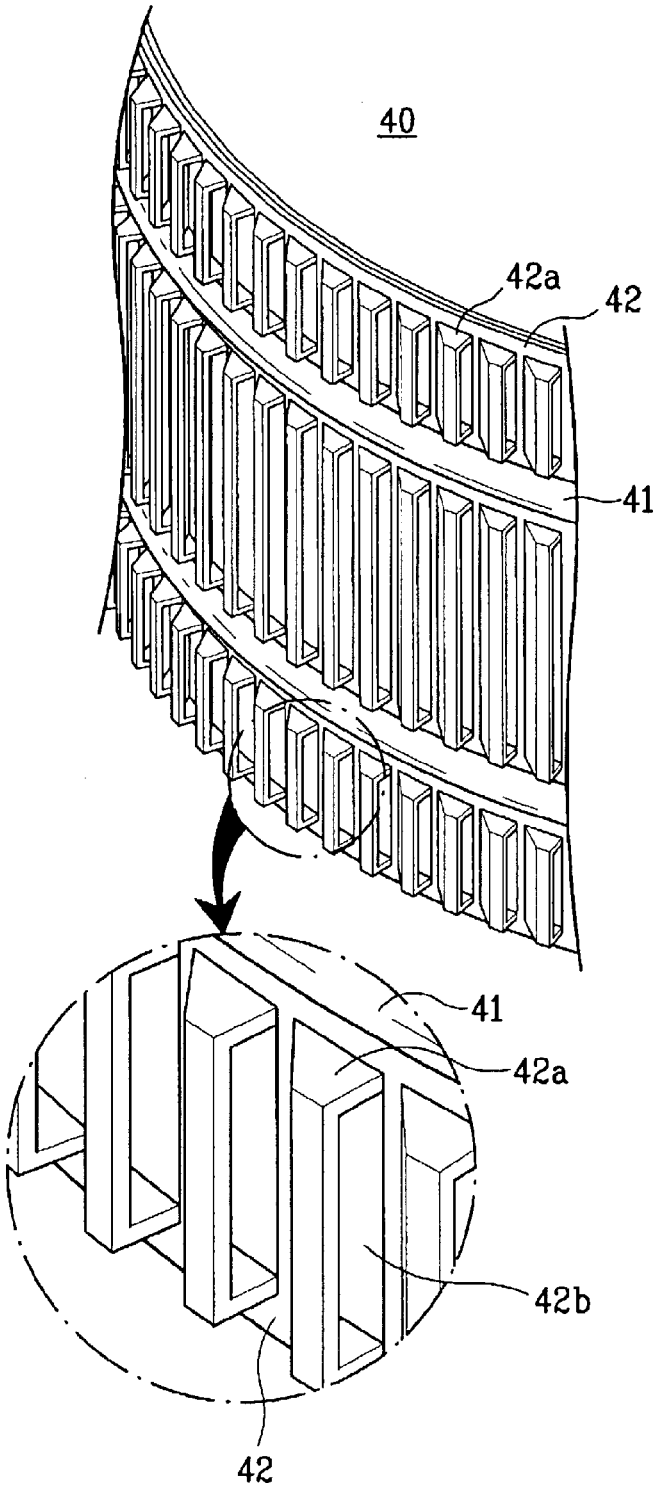
FIG. 5 illustrates a schematic view and an expanded view of an evaporator denoted by "A" of FIG. 3.

FIG. 5 is a schematic view and an expanded view of an evaporator seen from "A" in FIG. 3. As illustrated in FIG. 5, the fin and tube of the evaporator 40 used in the present invention are formed as a single body. That is, the evaporator 40 includes a tube 41 through which refrigerant flows and a high heat conductive material at a top part and bottom part, and a fin 42 is formed in the rest of the parts. And, the fin 42 includes a plurality of a louver 42*a* to be incised from a part of the fin and projected a louver 42*a* having a part being incised and a side being processed to be projected.

As illustrated in FIG. 5, the louver 42*a* remains a predetermined angle around the fin 2 by a punching process. The louver 42*a* is inclined to be parallel to a flow direction of air being exhausted from the double suction centrifugal blower 30.

In general, the centrifugal blower discharges air close to a tangent line direction and the louver 42*a* is formed close to be parallel to a tangent line direction of the double suction centrifugal blower 30 to secure smooth airflow at a location where the evaporator 40 is provided.

Therefore, air discharged from the double suction centrifugal blower 30 passes through an opening unit 42*b* guided by the louver 42*a* having the predetermined angle around the fin 42 and exchanging heat with the evaporator 40.

However, if a heat exchanger used as an evaporator in the present invention is not limited to the heat exchanger having the louver 42*a* and including the fin 42 and tube being as a single body and can cover the double suction centrifugal blower 30, other style heat exchangers can also be used.

Explaining the location of the evaporator 40 and the double suction centrifugal blower 30 being provided thereto, a hole is provided through which the freezing chamber 10*a* and the refrigerator chamber 10*b* passing at the central part of the mullion 20 as illustrated in FIG. 2.

Here, an air inlet of the double suction centrifugal blower 30 is provided in the direction of the freezing chamber and the refrigerator chamber, and an air outlet is provided in the cold airflow passage 20*a*. The evaporator 40 is provided to cover the outer circumferential surface of the double suction centrifugal blower 30. That is, the evaporator is provided to pass through a section of the cold airflow passage 20*a* and to cover the outer surface of the double suction centrifugal blower 30 so that air discharged from the double suction centrifugal blower 30 exchanges heat with a surface of the evaporator 40.

To have the above structure, the evaporator 40 is formed in spiral form along the outer surface of the double suction centrifugal blower 30 as illustrated in FIG. 3. And, as illustrated in FIG. 3, the evaporator 40 is provided in spiral form and a contact area of the evaporator 40 with the air sucked is increased.

It is not necessary to provide an evaporation chamber for providing the evaporator 40 in the freezing chamber 10*a* in the refrigerator according to the present invention. And, the evaporator 40 increases an electric heat area being in contact with air exhausted from the double suction centrifugal blower 30 for more effective heat exchange.

Hereinafter, operation of the refrigerator according to the present invention is explained in detail referring to FIGS. 2 and 3. When a refrigerating cycle is operated by operation of a compressor (not illustrated), the form of refrigerant absorbing latent heat is changed in the evaporator 40 being provided in the cold airflow passage 20*a* at the mullion 20 so as to lower temperature on the surface of the evaporator 40. Therefore, air being in contact with the surface of the evaporator 40 becomes cool air by heat exchange.

At the same time, air from the freezing chamber 10*a* and the refrigerator chamber 10*b* is sucked into the center of the double suction centrifugal blower 30 and exhausted from the side of the double suction centrifugal blower 30 by rotation of the double suction centrifugal blower 30 being provided at mullion 20.

Air being exhausted flows back into the cold airflow passage 20*a* provided in the mullion 20 and exchanges heat with the evaporator 40. Air exchanged heat with the evaporator 40 becomes cold air and flows into the freezing chamber 10*a* and the refrigerator 10*b* through a top outlet 21*a* and a bottom outlet 22*a*. Air flowed into the freezing chamber 10*a* and the refrigerator chamber 10*b* flows back to the center of the double suction centrifugal blower 30 after cooling the inside of the freezing chamber 10*a* and the refrigerator chamber 10*b*, and repeats the process.

In general, temperature of the refrigerator chamber 10*b* should be higher than that of the freezing chamber 10*a*. If the process mentioned above is repeated continuously, temperature of the refrigerator chamber 10*b* becomes the same as temperature of the freezing chamber 10*a*, and the refrigerator chamber 10*b* malfunctions.

An opening and shutting of a damper 50 is controlled by temperature of the refrigerator chamber 10*b*. When temperature of the refrigerator chamber 10*b* is over a fixed temperature, the damper 50 is opened and cool air in the cold airflow passage is flowed to the refrigerator chamber 10*b*. When temperature of the refrigerator chamber 10*b* is lower than the fixed temperature, the damper 50 is closed and cool air is excluded from flowing into the refrigerator chamber 10*b*.

The opening size of the damper 50 is adjustable to control temperature more precisely. That is, the damper controlling the amount of air flowed out is provided at the bottom outlet 22*a*.

Figure 6:
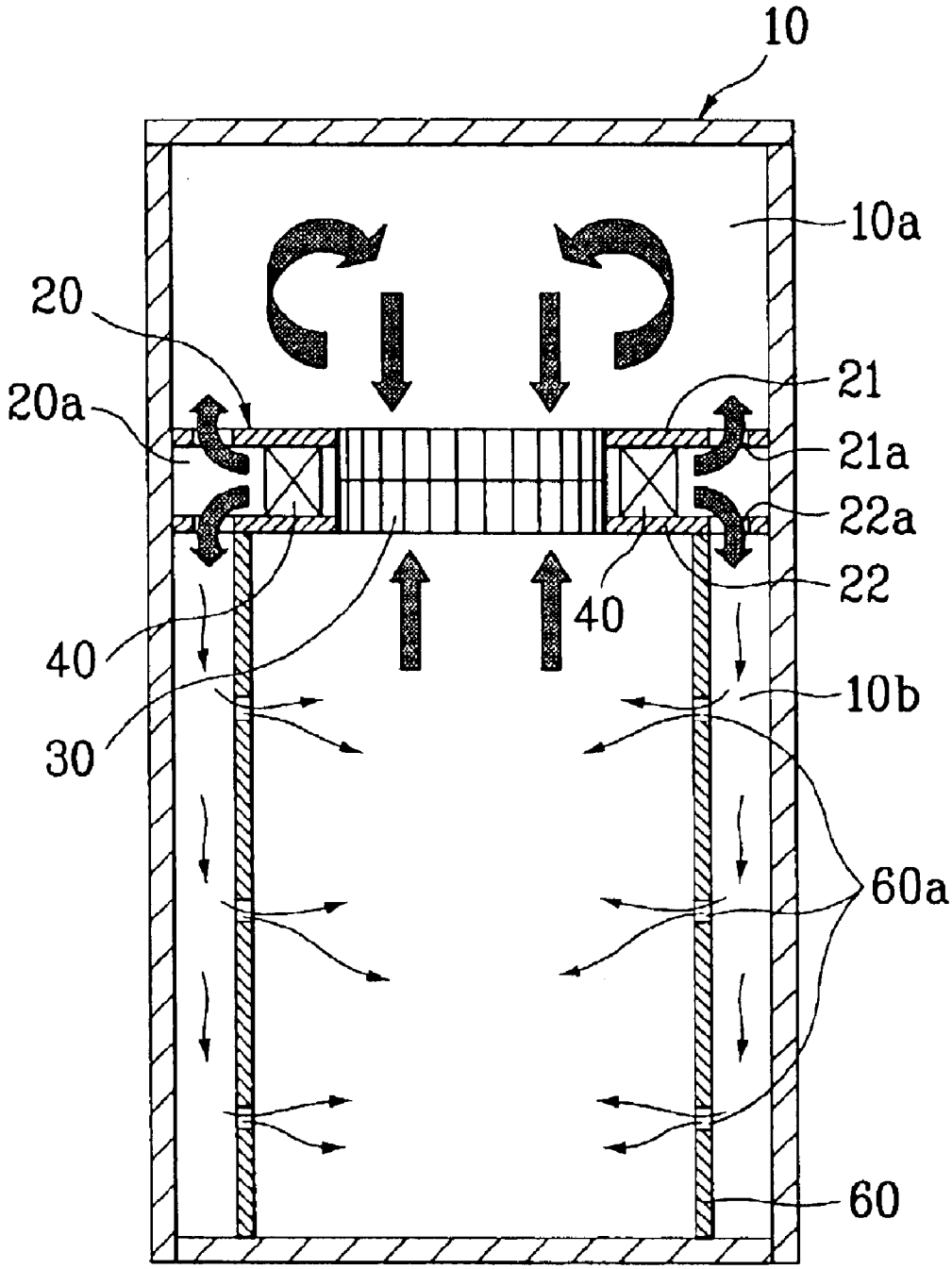
FIG. 6 illustrates a schematic view of a structure of a refrigerator according to a second embodiment of the present invention.

FIG. 6 is a schematic view of a second embodiment of the present invention. In the second embodiment, a cool air duct is provided in the refrigerator chamber. That is, the second embodiment is different from the first embodiment of the present invention in that the cool air duct is included and the damper is provided on the cool air duct.

The refrigerator includes the cabinet 10, the mullion 20, the double suction centrifugal blower 30, the top outlet 21*a*, the bottom outlet 22*a*, the evaporator 40 and the cool air duct 60 in the second embodiment in FIG. 6.

Here, a structure of the mullion and the evaporator is the same as that in the first embodiment. Therefore, only is a composition of the cool air duct explained in the second embodiment.

The cool air duct 60 is a passage of cool air and is provided to transmit cool air evenly in the refrigerator. Therefore, the cool air duct 60 is connected to the outlet 22*a* on the refrigerator chamber side in the cold airflow passage, extended from top to bottom of the refrigerator chamber 10*b*, and is provided on the side or at rear of the refrigerator chamber 10*b*. A plurality of aperture 60*a* is provided in the cool air duct 60*a*. Cool air is exhausted through a cool air through-hole 60*a*. Therefore, cool air is diffused into the refrigerator better than when cool air is exhausted straight from the bottom outlet 22*a* of the cold airflow passage 60 and a uniform temperature distribution is maintained in the refrigerator.

Also, as the same as the first embodiment explained in reference with FIG. 2, the damper is provided at the bottom outlet 22*a* in the cold airflow passage 20 for controlling temperature in the refrigerator. However, the damper can be provided at each of the aperture 60*a* provided in the cool air duct 60. That is, the damper opening and closing according to temperature in the refrigerator chamber 10*b* can be provided at the through-hole in the cool air duct. Also, the damper adjusting opening size according to temperature in the refrigerator chamber 10*b* can be provided for more precise temperature in the refrigerator chamber 10*b*.

The refrigerator using the double suction centrifugal blower 30 has advantages as followed. First, the evaporation chamber having an evaporator in the freezing chamber 10*a* is removed and the double suction centrifugal blower 30 and the evaporator 40 are provided at the mullion 20 so that the floor area ratio of the freezing chamber 10*a* is increased according to the present invention.

Second, utilization rate of electric heat is increased as the evaporator 40 is provided on the circumference of the double suction centrifugal blower 30 compared to the former art.

It will be apparent to those skilled in the art that various modifications and variation can be made in the present invention without departing from the spirit or scope of the invention. Thus, it is intended that the present invention covers the modifications and variations of this invention provided they come within the scope of the appended claims and their equivalents.

What is claimed is:

1. A refrigerator comprising:

a cabinet having a storage space;

a mullion provided in the cabinet to divide the storage space into a freezing chamber and a refrigerator chamber, the mullion having a cold airflow passage provided therein that is communicated with the freezing chamber and the refrigerator chamber;

a double suction centrifugal blower provided in a middle space of the mullion and sucking air from the freezing chamber and the refrigerator chamber and exhausting to the cold airflow passage; and an evaporator provided in the cold airflow passage for exchanging heat with the air exhausted from the double suction centrifugal blower.

2. The refrigerator of claim 1, wherein the evaporator comprises a fin and a refrigerant tube, the evaporator covering an outer circumferential surface of the double suction centrifugal blower.

3. The refrigerator of claim 2, wherein the evaporator comprises the fin and the refrigerant tube being as a single body.

4. The refrigerator of claim 2, wherein the fin comprises a plurality of a louver 42*a* having a side manufactured to be projected through the air by cutting a portion thereof and an opening formed between the cut portion and the louver.

5. The refrigerator of claim 4, wherein the louver is inclined to be parallel to a flow direction of air exhausted from the double suction centrifugal blower.

6. The refrigerator of claim 4, wherein the louver is inclined to be parallel to a tangent line direction of the double suction centrifugal blower.

7. The refrigerator of claim 1, the refrigerator further comprising:

a top outlet and a bottom outlet exhausting cool air being passed through the evaporator to the freezing chamber and the refrigerator chamber.

8. The refrigerator of claim 7, further comprises a damper opening and closing according to temperature of the refrigerator chamber at the bottom outlet of a cold airflow passage provided at a mullion.

9. The refrigerator of claim 7, further comprises a damper adjusting opening size according to temperature of the refrigerator chamber at the bottom outlet of a cold airflow passage provided at a mullion.

10. A refrigerator comprising:

a cabinet having a storage space;

a mullion provided in the cabinet to divide the storage space into a freezing chamber and a refrigerator chamber, the mullion having a cold airflow passage provided therein that is communicated with the freezing chamber and the refrigerator chamber;

a double suction centrifugal blower provided in a middle space of the mullion and sucking air from the freezing chamber and the refrigerator chamber and exhausting to the cold airflow passage; and an evaporator provided in the cold airflow passage and exchanging heat with air exhausted from the double suction centrifugal blower;

a plurality of top outlets and a plurality of bottom outlets exhausting air passed through the evaporator to the freezing chamber and the refrigerator chamber, respectively; and a cool air duct connected with the bottom outlet and extended from top to bottom of the refrigerator.

11. The refrigerator of claim 10, wherein the evaporator comprises a fin and a refrigerant tube and is formed to cover the outer circumferential surface of the double suction centrifugal blower 30.

12. The refrigerator of claim 11, wherein the fin and the refrigerant tube of the evaporator are formed as a single body.

13. The refrigerator of claim 11, wherein the fin comprises a plurality of a louver 42*a* having a side manufactured to be projected through the air by cutting a portion thereof and an opening formed between the cut portion and the louver.

14. The refrigerator of claim 13, wherein the louver is inclined to be parallel to a flow direction of air exhausted from the double suction centrifugal blower.

15. The refrigerator of claim 13, wherein the louver is inclined to be parallel to a tangent line direction of the double suction centrifugal blower.

16. The refrigerator of claim 10, wherein the cool air duct comprises a plurality of through-holes.

17. The refrigerator of claim 16, wherein the through-hole provided at the cool air duct comprises a damper opening and closing according to temperature of the refrigerator chamber.

18. The refrigerator of claim 16, wherein the through-hole provided at the cool air duct comprises a damper adjusting an opening size according to temperature of the refrigerator chamber.

* * * * *